US007839719B2

(12) United States Patent
Dopf et al.

(10) Patent No.: US 7,839,719 B2
(45) **Date of Patent: *Nov. 23, 2010**

(54) FLUID EROSION PROTECTION WASHER FOR ROTATING SHAFT IN MWD TOOL

(75) Inventors: Anthony R. Dopf, Calgary (CA); Trang Le, Calgary (CA); Derek Logan, Calgary (CA); Timothy Neff, Calgary (CA); Wendall Siemens, Alberta (CA); Dave Switzer, Calgary (CA)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/393,830

(22) Filed: Feb. 26, 2009

(65) Prior Publication Data

US 2009/0224193 A1 Sep. 10, 2009

Related U.S. Application Data

(63) Continuation of application No. 11/442,344, filed on May 30, 2006, now Pat. No. 7,532,540.

(60) Provisional application No. 60/712,440, filed on Aug. 31, 2005.

(51) Int. Cl.
*G01V 1/40* (2006.01)

(52) U.S. Cl. ..... 367/84; 277/411

(58) Field of Classification Search ..... 367/81, 367/82, 83, 84; 277/301, 305, 306, 307, 277/345, 411, 422
See application file for complete search history.

(56) References Cited

U.S. PATENT DOCUMENTS

| | | | |
|---|---|---|---|
| 3,701,535 | A | 10/1972 | Born et al. |
| 3,739,331 | A | 6/1973 | Godbey et al. |
| 3,770,006 | A | 11/1973 | Sexton et al. |
| 3,982,224 | A | 9/1976 | Patton |
| 4,914,057 | A | 4/1990 | Gloton |
| 5,103,430 | A | 4/1992 | Jeter et al. |
| 5,492,337 | A | 2/1996 | Lederman |
| 6,739,593 | B2 | 5/2004 | Fried |
| 7,222,861 | B2 | 5/2007 | Gittler |
| 7,327,634 | B2 * | 2/2008 | Perry et al. ..... 367/84 |

OTHER PUBLICATIONS

Office Action mailed Mar. 25, 2008, for U.S. Appl. No. 11/442,344.
Final Office Action mailed Oct. 2, 2008, for U.S. Appl. No. 11/442,344.

* cited by examiner

*Primary Examiner*—John Fox
(74) *Attorney, Agent, or Firm*—Schwabe, Williamson & Wyatt P.C.

(57) ABSTRACT

A shaft protection washer to protect a rotating shaft in a "measurement while drilling" (MWD) tool. Use of the shaft protection washer renders the rotating shaft less susceptible to erosion from the drilling fluid flowing between the rotating component and the stationary component.

11 Claims, 6 Drawing Sheets

FLUID EROSION PROTECTION WASHER FOR ROTATING SHAFT IN MWD TOOL

CROSS-REFERENCE TO RELATED APPLICATIONS

This application is a continuation of U.S. patent application Ser. No. 11/442,344, filed on May 30, 2006, which claims the benefit of U.S. Provisional Application No. 60/712,440, filed Aug. 31, 2005.

FIELD OF THE INVENTION

The present invention relates generally to fluid erosion protection means, and more particularly to means for protecting shafts used to rotate the components of mud pulsing measurement tools.

BACKGROUND OF THE INVENTION

Modern drilling techniques used for oil and gas exploration employ an increasing number of sensors in downhole tools to determine downhole conditions and parameters such as pressure, spatial orientation, temperature, gamma ray count, etc., that are encountered during drilling. These sensors are usually employed in a process called "measurement while drilling" (or "MWD"). The data from such sensors are either transferred to a telemetry device and thence up-hole to the surface, or are recorded in a memory device by "logging".

The oil and gas industry presently uses a wire (wireline), pressure pulses (mud pulse—MP) or electromagnetic (EM) signals to telemeter all or part of this information to the surface in an effort to achieve near real-time data. The present invention is specifically useful for a certain class of MP systems, although it can be useful in other telemetry or downhole control applications.

In MP telemetry applications there is a class of devices that communicate by a rotary valve mechanism that periodically produces encoded downhole pressure pulses on the order of 200 psi. These pulses are detected at the surface and are decoded in order to present the driller with MWD information. These rotary valves are preferentially driven by electric gearmotors.

The rotary valve mechanism comprises a stationary component and a rotating component. The stationary component, the "stator", has fluid pathways for the drilling fluid as it is forced down the pipe housing the pulser. A second component, the "rotor", is designed such that it can rotate to line up with the stator to create "open" and "closed" positions; when the rotor moves to the "closed" position the fluid pathway area is significantly restricted, causing the fluid velocity to increase in the vicinity of the rotor/stator assembly. This process is further described in U.S. Pat. No. 3,739,331.

The rotating component typically utilizes a shaft connected to a drive mechanism. This shaft is subject to abrasive conditions in the downhole environment due to the turbulent high velocity fluid flowing past; furthermore, this fluid is normally highly abrasive due to the inclusion of particulate matter such as sand. An example of a prior art MWD tool is shown in U.S. Pat. No. 3,982,224, where it can be seen that the drilling fluid can readily flow between the rotor and stator and erosion could result.

In summary:

- the downhole rotary valve mechanism in most cases employs a rotary output shaft, and
- the shaft is exposed to a highly abrasive environment causing erosion.

What is required, therefore, is some means to protect the shaft associated with the rotor from erosion.

Conventional methods of protection have had only limited success. There have been some attempts to shield the shaft from erosion by creating a stepped edge from the stator that the rotor slides over (as is taught, for example, in U.S. Pat. No. 4,914,057) but this type of technique adds significant mechanical complexity and cost.

SUMMARY OF THE INVENTION

It is an object of the present invention to counter the deleterious and undesired effects of erosion from turbulent drilling fluid on a vulnerable rotating shaft. While the present invention is primarily directed to a class of downhole MWD tools, the present invention is not limited to this situation, but can also be applied to any rotating shaft in an abrasive fluid, as would be obvious to anyone skilled in the relevant art.

According to a first aspect of the present invention there is provided a shaft protection washer for use with a shaft assembly operable in fluid environments, the shaft assembly comprising:

- a shaft;
- a stationary member having a bore at least partially therethrough for rotatably receiving the shaft;
- a rotating member fixedly mounted on the shaft for rotation therewith and axially spaced from the stationary member; and
- a gap formed by axial spacing of the stationary member and the rotating member;
- wherein the shaft protection washer is for seating in the gap without contacting the rotating member and such that the width of the gap is reduced and comprises a central aperture for receiving the shaft, thereby reducing the effect of fluid erosion on the shaft.

According to a second aspect of the present invention there is provided a shaft assembly operable in fluid environments, the shaft assembly comprising:

- a shaft;
- a stationary member having a bore at least partially therethrough rotatably receiving the shaft;
- a rotating member fixedly mounted on the shaft for rotation therewith and axially spaced from the stationary member;
- a gap formed by axial spacing of the stationary member and the rotating member; and
- a shaft protection washer seated in the gap without contacting the rotating member and such that the width of the gap is reduced and comprising a central aperture receiving the shaft, thereby reducing the effect of fluid erosion on the shaft.

According to a third aspect of the present invention there is provided a rotary valve mechanism for use in fluid environments, the rotary valve mechanism comprising:

- a shaft;
- a stationary member having a bore at least partially therethrough rotatably receiving the shaft;
- a rotating member fixedly mounted on the shaft for rotation therewith and axially spaced from the stationary member;
- a gap formed by axial spacing of the stationary member and the rotating member; and
- a shaft protection washer seated in the gap without contacting the rotating member and such that the width of the gap is reduced and comprising a central aperture receiving the shaft, thereby reducing the effect of fluid erosion on the shaft.

In exemplary embodiments of the present invention, the central aperture is defined by a peripheral edge, the peripheral edge being provided with either a flange extending axially from the shaft protection washer for receiving the shaft, or two flanges extending axially from the shaft protection washer in opposite directions, for receiving the shaft. The shaft protection washer can be composed of at least two parts, and is preferably composed of an erosion resistant material.

By a simplified analysis of fluid flow around the shaft components, which is set out in detail below, it can be demonstrated how to protect a shaft from erosion by providing a protection washer according to the present invention. Diverse materials were tested, including plastics and polymers, and trials have shown that exceptionally strong materials such as tungsten carbide and ceramics are particularly suitable due to their erosion resistant characteristics.

Various shapes of washers can be considered in order to complement the geometry of a given rotor/stator assembly, but the primary objective is to at least partially surround the shaft driving the rotor and, in so doing, shield it from the eroding effects of the drilling fluid.

A detailed description of an exemplary embodiment of the present invention is given in the following. It is to be understood, however, that the invention is not to be construed as limited to this embodiment. The exemplary embodiment set out below is directed to mud pulse rotors, but the invention may be applied to other applications for addressing abrasive fluid flow axially along shafts in other MWD tools, other drilling systems, and in non-downhole environments.

BRIEF DESCRIPTION OF THE DRAWINGS

In the accompanying drawings, which illustrate an exemplary embodiment of the present invention.

DETAILED DESCRIPTION OF AN EXEMPLARY EMBODIMENT

Figure 1:
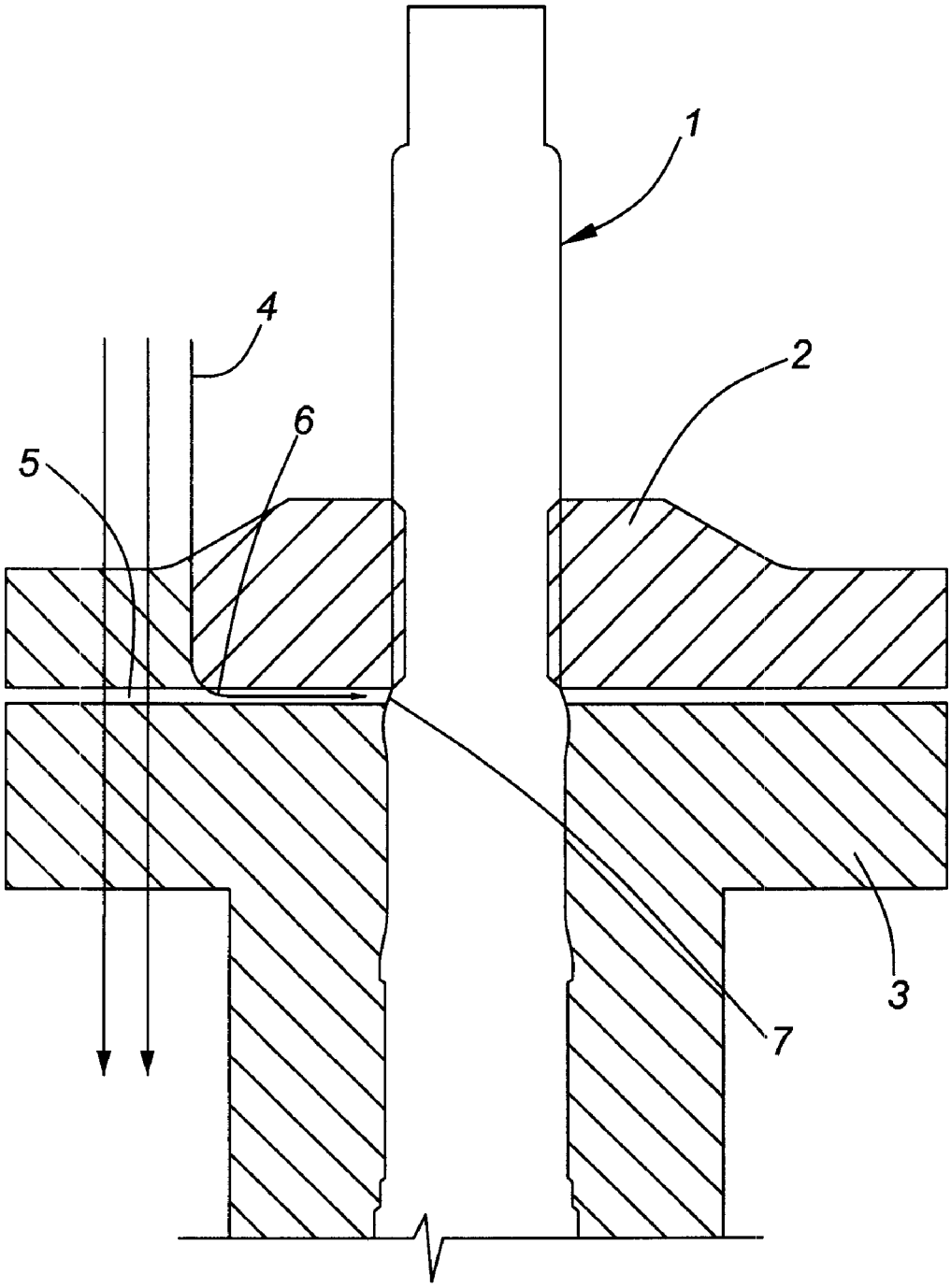
(PRIOR ART) FIG. 1
FIG. 1 is an elevation view, partially in section, illustrating a prior art rotary valve assembly with a shaft, stator and rotor.

Referring now in detail to FIG. 1, the basic components of a prior art rotary valve are shown. In the case of a mud pulser tool, the motor-actuated rotary valve periodically interrupts at least part of the drilling fluid flow, thereby generating a pressure wave in the fluid. A rotary valve is positioned so that the drilling fluid flows through the drill string, through the valve, whereby a pressure wave signal will be generated in the drilling fluid as the valve opens and closes in response to a downhole condition. The drilling fluid 4 flows generally axially to the shaft 1 past the rotor 2, which is affixed to the shaft 1. Due to the separation of the rotor 2 and the stator 3, a gap 5 is created. While in an open position, the fluid 4 will flow readily through the aligned openings. While in the closed position, however, the flow will be constrained, but still able to flow into the gap 5, and at a greater velocity. Regardless of positioning, the flow profile 6 shows how the fluid enters the gap 5 between the rotor 2 and stator 3, similar to an orifice, which causes deceleration in fluid velocity along the length of the gap 5. This is, however, still enough to cause erosion 7 to the shaft 1, especially as the gap 5 width is increased with adjustments to the separation between the rotor 2 and stator 3.

Figure 2A:
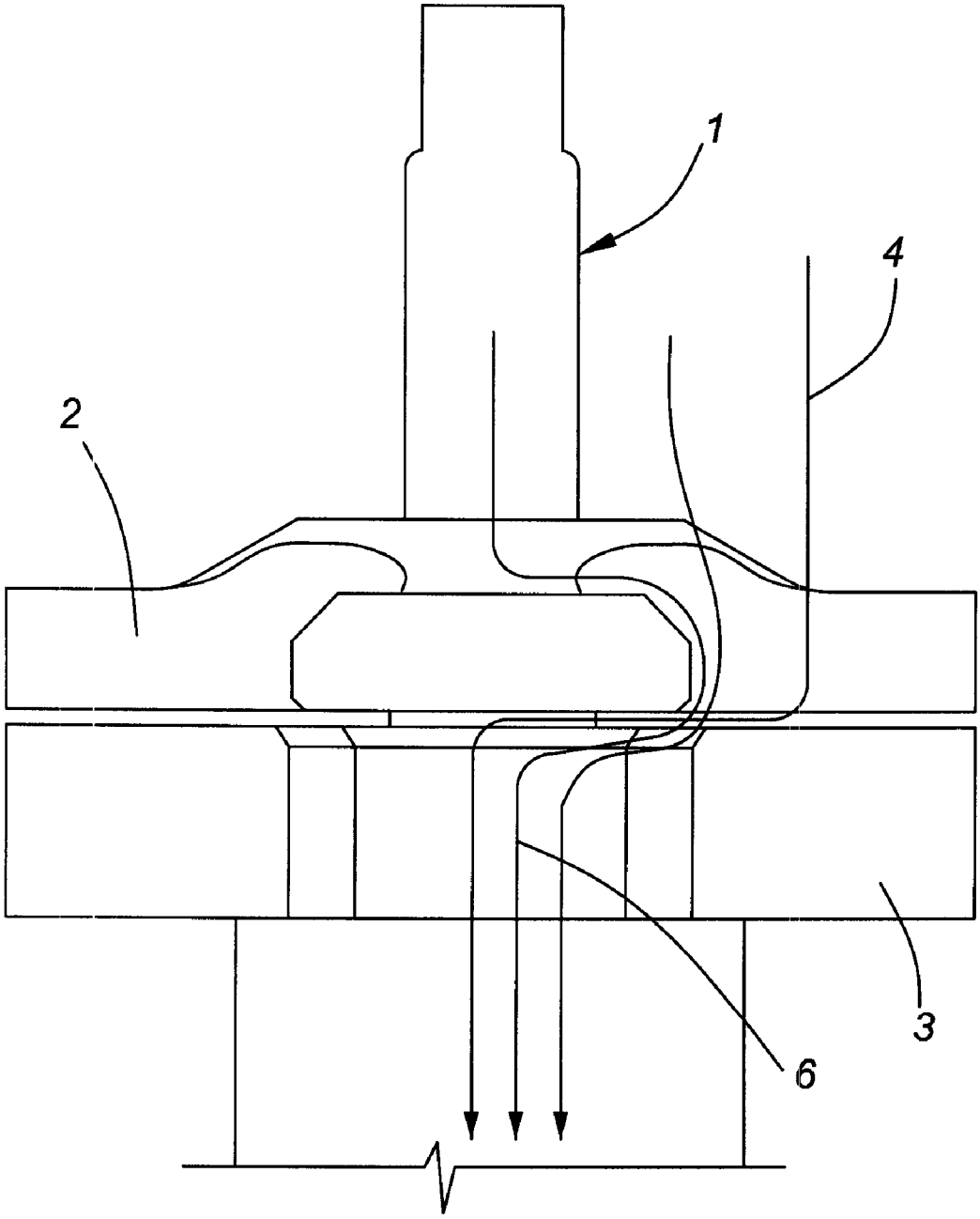
(PRIOR ART) FIG. 2A
FIG. 2A is a schematic elevation view of a prior art rotary valve assembly in the "closed" position.
Figure 2B:
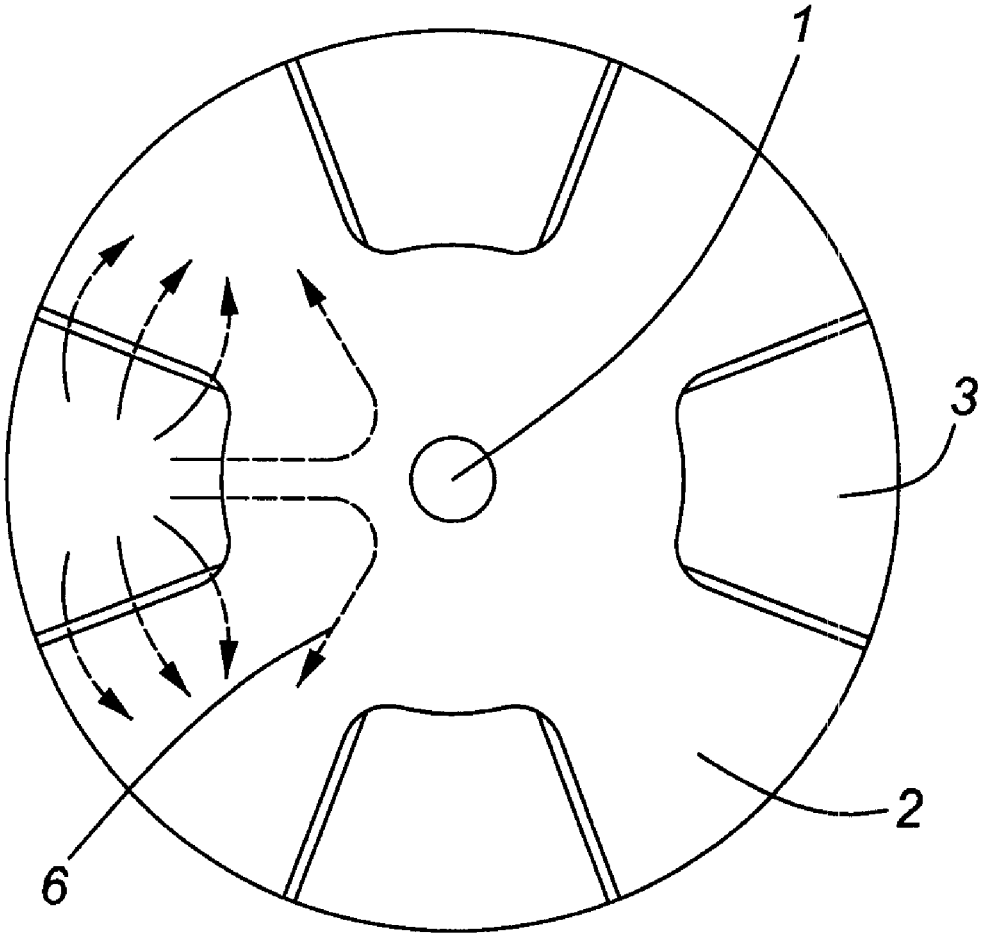
(PRIOR ART) FIG. 2B
FIG. 2B is a top plan view of a prior art rotary valve assembly in the "closed" position.

While in the "closed" position, the greatest amount of erosion occurs. As shown in FIG. 2A, the drilling fluid 4 flows around the rotor 2 arms and hits the stator 3 arms. The fluid 4 then is required to flow under the rotor 2. Referring to FIG. 2B, the fluid will generally flow as illustrated by the flow profile 6 (dashed lines represent flow directly under the rotor 2). As shown, some of the fluid 4 flows into the gap toward the shaft 1 and back out again.

Figure 3:
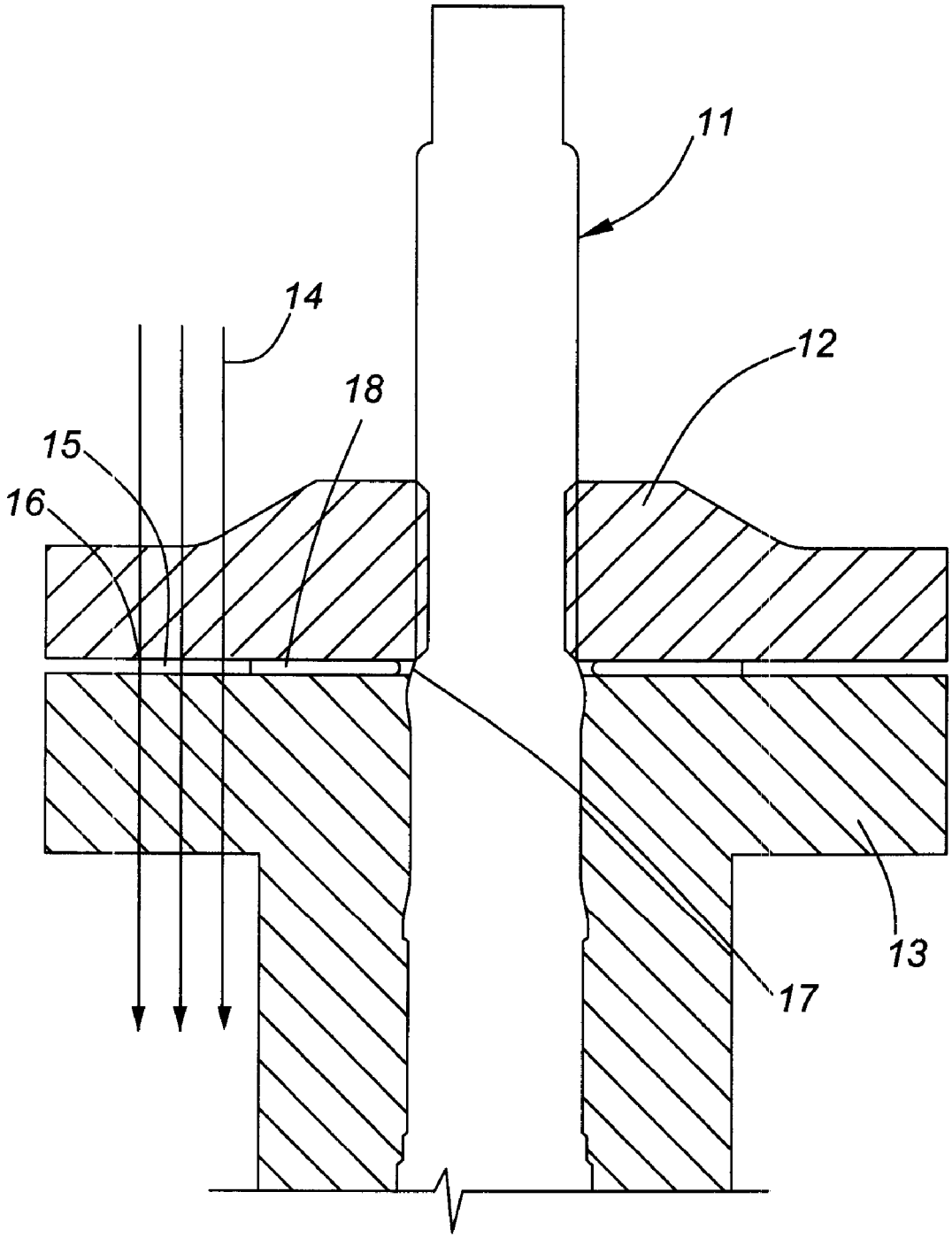
FIG. 3 is an elevation view, partially in section, illustrating an assembly according to the present invention, with the addition of a washer to protect the shaft from erosion.

Referring now in detail to FIG. 3, an exemplary embodiment of the present invention is illustrated. The gap 15 is provided with means that can be employed to mitigate the effect of the erosion 17 caused from the flowing fluid 14 (the flow profile 16 being indicated)—specifically, a washer 18 which causes a significant reduction of the gap 15 width for the fluid 14 to flow into. With the gap 15 width being reduced while the gap 15 length remains the same, the deceleration is increased.

Consider the equation for maximum velocity for fluid flow between two infinite parallel plates:

$$u_{max} = \frac{1}{8\mu}\frac{\partial p}{\partial x}h^2 \qquad [1]$$

where $u_{max}$=maximum velocity of the fluid, $\mu$=fluid viscosity, h=width of gap for fluid flow, and $\partial p/\partial x$=change of pressure over length of fluid flow channel.

All conditions remaining the same, the maximum velocity of fluid flow is then directly proportional to the square of the fluid flow gap width. A decrease in maximum velocity in the gap 15, therefore, decreases turbulence as well as the rate of particulate flow in the area. The presence of the washer 18 accordingly reduces the effective value of h, and in so doing reduces $u_{max}$, leading to a significant reduction in erosion.

Figure 4:
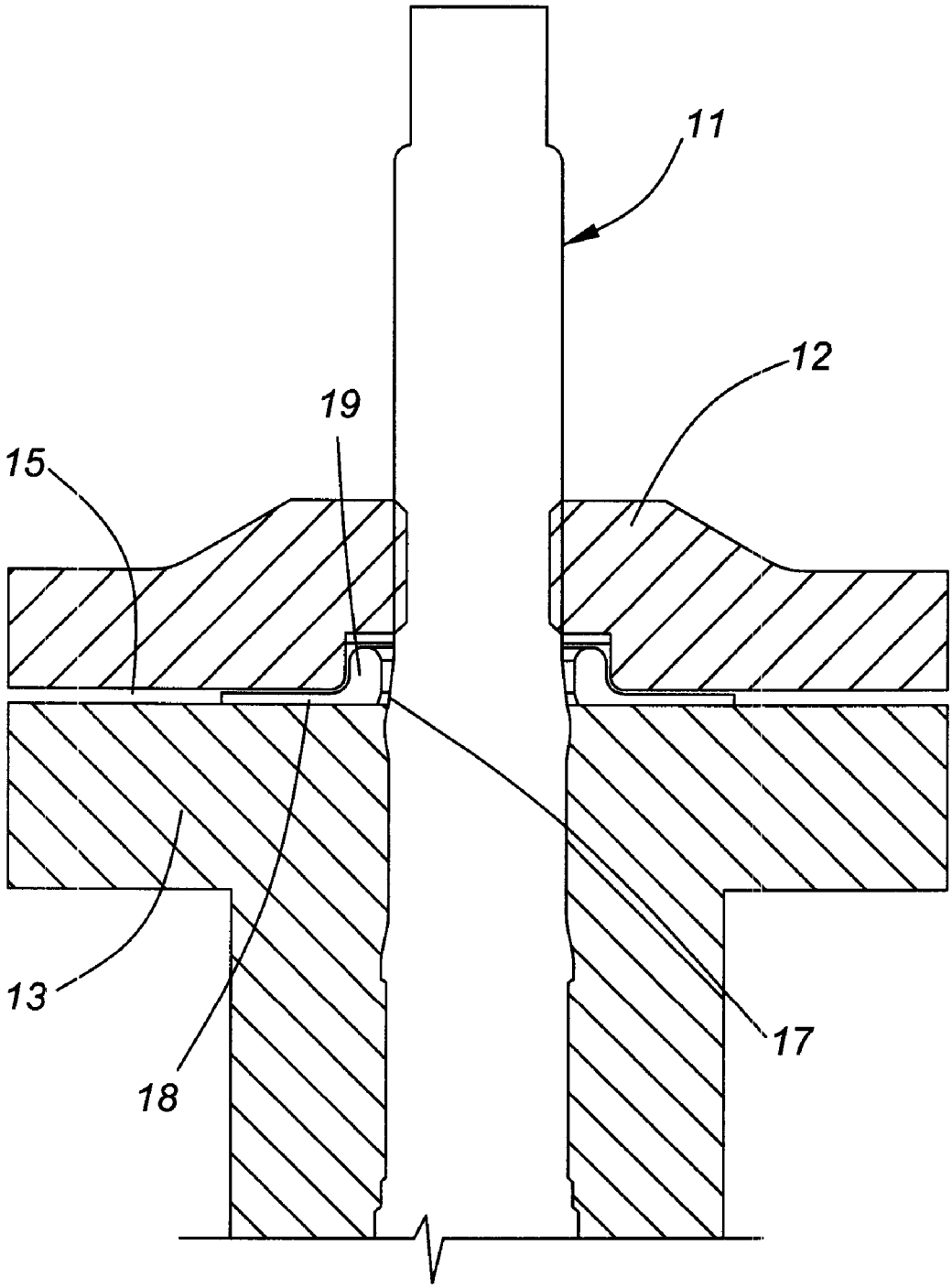
FIG. 4 is an elevation view, partially in section, illustrating an assembly according to the present invention with an alternative washer configuration.

As is shown in FIG. 4, the shape of the washer 18 can be altered to provide enhanced protection from shaft erosion 17. A stepped edge or flange 19 can be added to the washer 18, either on one face (as shown) or on both faces (given an appropriate rotor/stator arrangement). With an increase in the length of fluid travel along the gap 15 constraining fluid flow to follow a more convoluted path, the flow velocity is greatly decreased. Additionally, the stepped edge or flange 19 holds the washer 18 in place by the rotor 12, preventing potential shaft 11 wear due to vibration of the washer 18 against the shaft 11. This configuration can be achieved by creating the washer 18 out of one solid piece (as shown) or by dividing it into two or more pieces.

Figure 5:
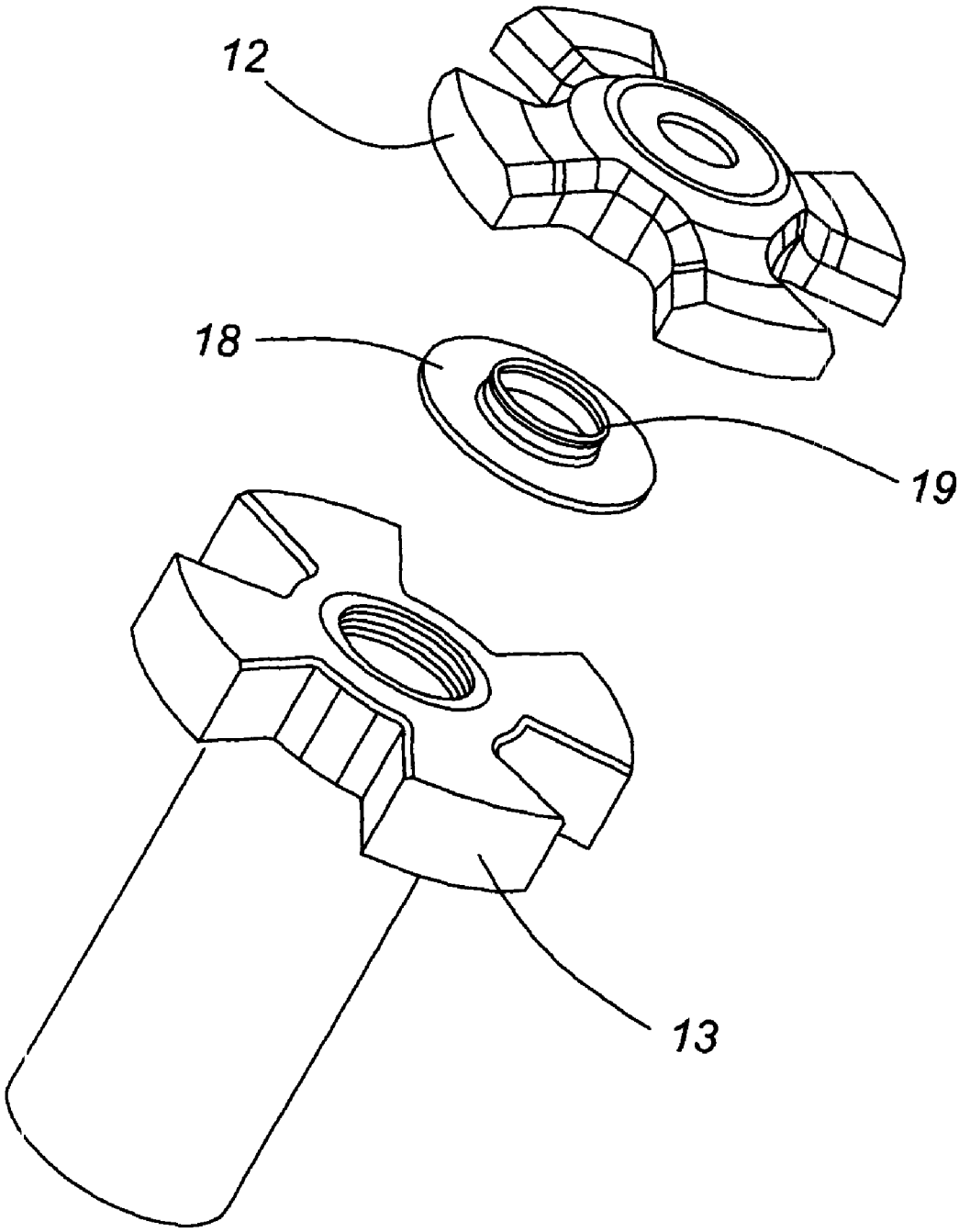
FIG. 5 is an exploded perspective view of the assembly of the rotor, stator and shaft protection washer.

FIG. 5 illustrates an exemplary embodiment of the assembly of the washer 18, with a single stepped edge 19, housed between the rotor 12 and stator 13.

While a particular embodiment of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment. The invention is therefore to be considered limited solely by the scope of the appended claims.

The invention claimed is:

1. A rotary valve mechanism for use in fluid environments, the rotary valve mechanism comprising:

a shaft;

a stator having a body with at least one fluid opening axially therethrough and a bore at least partially axially therethrough rotatably receiving the shaft;

a rotor having a body with at least one fluid opening axially therethrough, the body being fixedly mounted on the shaft for rotation therewith and axially spaced from the stator;

a gap formed by axial spacing of the stator member and the rotor, the gap in fluid communication with the shaft and the fluid openings of the rotor and stator; and a shaft protection washer comprising a central aperture receiving the shaft, wherein the washer is seated in a portion of the gap without contacting the rotor such that fluid can flow through the portion of the gap disposed between the washer and the rotor and such that the width of the portion of the gap occupied by the washer is reduced thereby impeding fluid from reaching the shaft when flowing through the rotor or stator fluid opening and into the portion of the gap not occupied by the washer.

2. The rotary valve mechanism of claim 1 wherein the shaft protection washer is composed of an erosion resistant material.

3. The rotary valve mechanism of claim 1 wherein the washer when seated has an outer perimeter which does not overlap with the fluid openings of the rotor and stator.

4. The rotary valve mechanism of claim 1 wherein the rotor and stator each further comprise arms radially extending from the respective rotor and stator body and spaced apart to define the respective fluid opening between each pair of arms.

5. The rotary valve mechanism of claim 4 wherein the rotor and stator each comprise four arms with four fluid openings therebetween.

6. A shaft assembly operable in fluid environments, the shaft assembly comprising:

a shaft;

a stationary member having a body with a bore at least partially axially therethrough rotatably receiving the shaft ;

a rotating member having a body fixedly mounted on the shaft for rotation therewith and axially spaced from the stationary member ;

a gap formed by axial spacing of the stationary member and the rotating member, the gap in fluid communication with the shaft; and a shaft protection washer comprising a central aperture receiving the shaft, wherein the washer is seated in a portion of the gap without contacting the rotating member such that fluid can flow through the portion of the gap disposed between the washer and the rotor and such that the width of the portion of the gap occupied by the washer is reduced thereby impeding fluid from reaching the shaft when flowing axially past the rotating member or stationary member and into the portion of the gap not occupied by the washer.

7. The rotary valve mechanism of claim 6 wherein the shaft protection washer is composed of an erosion resistant material.

8. A shaft assembly as claimed in claim 6 wherein the rotating member is a rotor having a body with a fluid opening extending axially therethrough, and the stationary member is a stator having a body with a fluid opening extending axially therethrough, and the rotor is rotatable relative to the stator such that the fluid openings of the rotor and stator can be aligned and not aligned.

9. The shaft assembly of claim 8 wherein the washer when seated has an outer perimeter which does not overlap with the fluid openings of the rotor and stator.

10. The shaft assembly of claim 9 wherein the rotor and stator each further comprise arms radially extending from the respective rotor and stator body and spaced apart to define the respective fluid opening between each pair of arms.

11. The shaft assembly of claim 10 wherein the rotor and stator each comprise four arms with four fluid openings therebetween.

* * * * *